United States Patent [19]

Guyot

[11] 4,086,515

[45] Apr. 25, 1978

[54] NON-DESTRUCTIVE READ-OUT DEVICE

[75] Inventor: Lucien Guyot, Paris, France

[73] Assignee: Thomson-CSF, Paris, France

[21] Appl. No.: 598,054

[22] Filed: Jul. 22, 1975

[30] Foreign Application Priority Data

Jul. 26, 1974 France ..... 74 26061

[51] Int. Cl.[2] ..... H01J 31/26

[52] U.S. Cl. ..... 315/10; 315/13 ST

[58] Field of Search ..... 315/10, 11, 383, 13 ST; 340/173 CR; 357/31

[56] References Cited

U.S. PATENT DOCUMENTS

| | | | |
|---|---|---|---|
| 2,930,929 | 3/1960 | Shelton | 315/10 |
| 3,087,985 | 4/1963 | Heijne et al. | 315/11 |
| 3,176,183 | 3/1965 | Jensen et al. | 315/11 |
| 3,599,055 | 8/1971 | Bloom | 315/11 |
| 3,629,499 | 12/1971 | Carlson | 315/10 |
| 3,975,657 | 8/1976 | Sato et al. | 315/10 |

*Primary Examiner*—Maynard R. Wilbur
*Assistant Examiner*—T. M. Blum
*Attorney, Agent, or Firm*—Roland Plottel

[57] ABSTRACT

A device for the non-destructive electrical read-out of a light image, using an electronic tube which comprises in particular a target for recording and read-out of the image and an electrongun for scanning the image. The read-out device is constituted by the tube and means which divide by a factor of *n* the electron beam current, thus preventing the destruction of the light information during *n* successive read-out operations.

12 Claims, 2 Drawing Figures

NON-DESTRUCTIVE READ-OUT DEVICE

The present invention relates to electrical image reading using an electronic tube and more particularly to a device in which read-out is effected in non-destructive fashion.

Electronic tubes of a kind used to scan light images, for example vidicons, conventionally comprise a target for the recording and read-out of the image, and an electron-gun in order to scan the target. The electron beam produced by the scanning gun and appropriately concentrated, scans the target point by point, the target for example being constituted by a photoconductive film applied to a transparent conductor. Thus, at each point on the photoconductor film it deposits negative charges whilst the conductor is maintained at a positive potential, so that a potential difference develops between the two faces of the target. When the photoconductive film receives a light image, the potential of the two faces tend to equalise at the illuminated points. The electron beam, during ensuing scanning, deposits at said points the requisite amount of negative charges to bring them to the cathode potential, resulting in a current flow through a resistor connected to the target. Across the terminals of the resistor an electrical readout signal is picked off, proportional to the quantity of light received between two successive scans by the electron beam.

A major drawback of this device is that the mechanism of read-out of the image is a destructive one: in other words, from the above it will be clear that the target is uniformly placed at the cathode potentiel after the scanning of the electron beam.

According to the invention, there is provided a non-destructive electrical read-out device for image read-out, comprising, within an evacuated envelope:

means for emitting an electron beam and located at a first end of said envelope;

a target located at a second end of the envelope and placed at a bias voltage, on to which said image is projected, thus locally modifing the potential distribution;

means for deflecting the electron beam and producing scanning of said target by said beam, and for furnishing a read-out signal which is a function of said potential distribution; said device further comprising means for reducing the quantity of electricity deposited by said electron beam on said target, by an amount which is a function of said read-out signal.

For a better understanding of the invention and to show how the same may be carried into effect, reference will be made to the following description and the related drawings in which.

Figure 1:
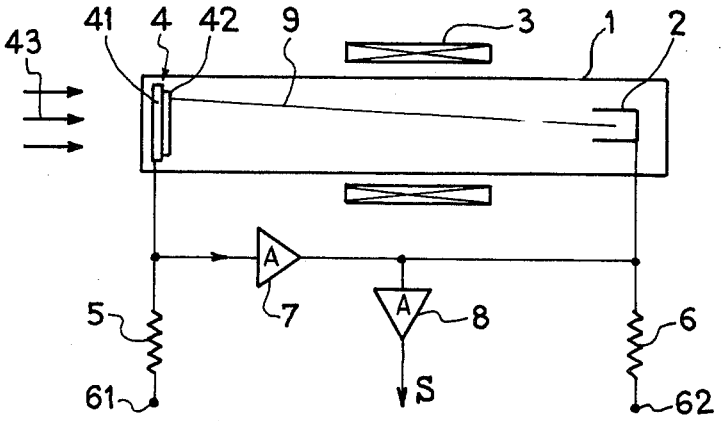
FIG. 1 illustrates an embodiment of the device in accordance with the invention.

In the drawings, like references denote like components.

In FIG. 1, there is shown a highly schematic representation of an evacuated envelope 1 containing an electron-gun 2 emitting an electron beam 9 and in fact constituted in accordance with the prior art designs by several electrodes (cathode, grids and anode), electromagnetic means for concentrating and deflecting the beam, illustrated by a magnetic winding 3, and finally a target 4 constituted for example by an electrically conductive film 41 and a photoconductive film 42, the beam 9 striking the face 42 and the image which is to be read out (arrows 43) being projected onto the face 41. The electron-gun 2 and the target 4 are respectively connected to terminals 62 and 61 furnishing appropriate bias voltages, namely a positive potential in relation to that of the cathode of the electron-gun 2, in the case of the target 4, the bias voltages being supplied across respective resistors 6 and 5.

The device shown in FIG. 1 moreover comprises an amplifier 7 of gain $G_1$ connected between the target 4 and the electron-gun 2, more especially the cathode of the latter, and a second amplifier 8, of gain $G_2$, connected to the output of the amplifier 7 and furnishing a signal S at its own output.

As stated earlier, in the absence of any light information there is a potential difference between the two faces of the target 4, since the conductor 41 is placed at a positive potential in relation to the cathode of the electron-gun 2 and the photoconductor 42 is maintained at the potential of the cathode by the scanning action of the beam 9. The projection of the light information 43 renders the film 42 locally conductive and consequently modifies the distribution of the potentials at the surface 42. The later scanning of the film 42 by the beam 9, in the absence of the loop containing the amplifier 7 which connects the target 4 to the electron-gun 2, has the effect of returning the film 42 to the cathode potential so that a current flows in particular across the resistor 5, across terminals of which the read-out signal can be picked off. The presence of said loop has the effect of dividing by a factor $n$ the amount of charges per unit time transferred by the beam 9 to the target 4, the factor $n$ being a function of the gain $G_1$ of the amplifier 7. The received information, recorded in the form of a potential relief at the surface 42, is therefore not erased after a single scan.

In this embodiment, the read-out signal is picked off at the output of the amplifier 7 and it is advantageous that it should be reamplified by the second amplifier 8, since the signal level is quite low.

This device therefore enables long-term read-out to be effected without modifying the structure of the target 4. However, it should be pointed out that the beam 9 nevertheless erases the whole of the received information at the end of $n$ scanned frames.

In addition, in order to prevent the target 4 from becoming too negatively charged as scanning goes on, it is possible to bombard the target with a beam 9 of sufficient energy to ensure that the second electron emission coefficient at the bombarded face, is greater than 1. Another solution aimed at preventing too high a negative charge on the target, consists in introducing ions which can be created for example by interaction between the electrons of the beam and residual gas molecules inside the tube.

Figure 2:
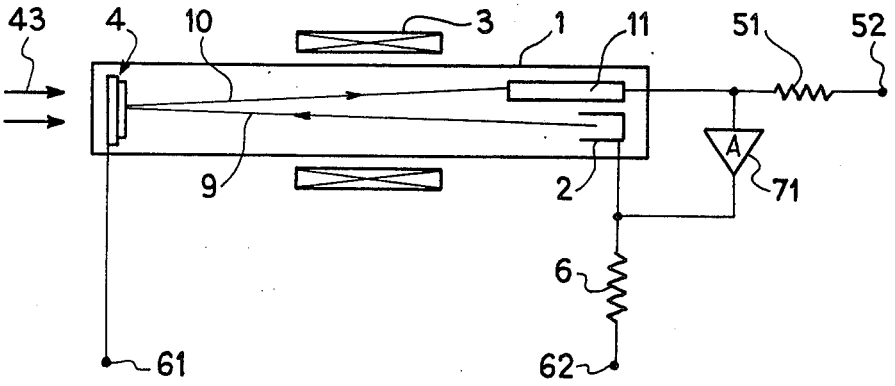
FIG. 2 illustrates a variant embodiment of this device.

FIG. 2 illustrates a variant embodiment of the device in accordance with the invention, in which a reflected electron beam is used.

In this embodiment, in the envelope 1 the electron-gun 2 emitting an electron beam 9 towards the target 4 is encountered again; the cathode of the electron-gun 2 is connected to a terminal 62 and the target 4 to a terminal 61. The target 4 is placed at a bias potential such that the beam (marked 10) is returned in the aggregate towards the other end of the tube, after having been modulated by the target potential, that is to say after having left a charge quantity proportional to the local illumination. An electron-multiplier is arranged in the path of the return beam 10 and is designed in a manner known per se, being schematically indicated by a box 11 receiving the beam 10 and connected to a supply terminal 52 through the medium of a resistor 51. At the output of the electron-multiplier there is connected an amplifier 71 whose output is connected to the cathode of the electron-gun 2 and which furnishes the read-out signal.

The operation of this device is similar to that of the aforegoing device, the amplifier 71 in FIG. 2 having the same function as that 7 of FIG. 1: it divides by a factor of $n$ the amount of charges introduced by the beam 9, the factor $n$ here being a function of the gain of the amplifier 71 and of the gain of the electron-multiplier 11.

This embodiment has the chief advantage of reducing the noise introduced by the amplifying operation, into the output signal, in relation to that introduced into the device of FIG. 1. In other words, the modulated signal constituting the read-out signal is already amplified a first time by the electron-multiplier 11, this being a method of amplification which introduces very little noise, and the signal-to-noise ratio at the output of the amplifier 71 is thus substantially better than said same ratio at the output of the amplifier 7 shown in FIG. 1.

The read-out device in accordance with the invention has been described by way of a non-limitative example in the context of a camera tube of the vidicon type, comprising a photoconductive target. The invention, of course, is applicable to other kinds of tubes, for example to dielectric target storage-type tubes or again to image detector tubes comprising targets of a different kind in which, under the action of a light image, positive or negative electrical charges may occur, as for example piezoelectric targets, pyroelectric targets or photovoltaic targets. The invention is particularly effective in other words in targets of the kind where the build-up of negative charges constitutes a major problem.

More generally speaking, the invention is applicable to any device in which information appears or is stored in the form of an electrical charge on a target.

What is claimed is:

1. A non-destructive electrical read-out device for image read-out, comprising within an evacuated envelope:

means for emitting an electron beam located at a first end of said envelope;

a target located at a second end of the envelope and placed at a bias voltage, on to which said image is projected, thus locally modifying the potential distribution;

means for deflecting the electron beam and producing scanning of said target by said beam, and for furnishing a read-out signal which is a function of said potential distribution; said device further comprising means for reducing the quantity of electrons deposited by said electron beam on said target, by an amount which is a function of said read-out signal, said function being proportional to approximately $1/n$ of the quantity of electrons needed to restore said potential distribution to its unmodified condition.

2. A device as claimed in claim 1, wherein said means for reducing the quantity of electrons comprise an amplifier connected between said target and said means for emitting an electron beam.

3. A device as claimed in claim 1, wherein said target bias voltage enables said beam to be reflected towards said first end of the envelope, constituting a return beam, said device further comprising a collector for said return beam, said means for reducing the quantity of electrons comprising an amplifier connected between said collector and said means for emitting the beam.

4. A device as claimed in claim 2, wherein said means for emitting an electron beam comprise a cathode, said amplifier being connected to said cathode.

5. A device as claimed in claim 3, wherein said means for emitting an electron beam comprise a cathode, said amplifier being connected to said cathode.

6. A device as claimed in claim 3 further comprising an electron-multiplier arranged in the path of said return beam.

7. A read-out device as claimed in claim 2, wherein said read-out signal is picked off from the output of said amplifier.

8. A read-out device as claimed in claim 3, wherein said read-out signal is picked off from the output of said amplifier.

9. A non-destructive electrical read-out device which comprises, an evacuated envelope:

means, located at one end of said envelope, for emitting an electron beam;

a target, located at the other end of said envelope, for receiving the image to be read, the beam from said beam emitting means impinging upon said target;

means for biassing said target with a potential relative to said emitting means, said image inducing a local modification of the potential distribution on said target;

means for deflecting said electron beam to scan said target;

means, operatively associated with said biassing means, for deriving a read-out signal which is a function of said potential distribution; and means, including a first amplifier, of gain G1, for reducing the beam current of said beam by a factor $1/n$, $n > 1$, where $1/n$ beam current contains the amount of change needed to erase said local modification of said potential distribution in about $n$ sweeps of said beam whereby said deflecting means can scan said image $n$ times before erasing said modified potential distribution.

10. The read-out device according to claim 9 wherein said beam reducing means is connected between said target and said beam emitting means.

11. The read-out device according to claim 10 further comprising a second amplifier, of gain G2, connected to the output of said first amplifier, said read-out signal comprising the output of said second amplifier.

12. The read-out device according to claim 9 wherein said biassing means applies a potential to said target of sufficient magnitude to induce secondary emission on said target, said device further comprising an electron-multiplier in the path of the return beam comprised of said secondary emission electrons, said current reducing means being connected between said electronmultiplier and said beam emitting means.

* * * * *